US008256059B2

(12) United States Patent
Morphey

(10) Patent No.: US 8,256,059 B2
(45) Date of Patent: Sep. 4, 2012

(54) BRUSHROLL WITH SOUND REDUCING FEATURES

(75) Inventor: John Morphey, Normal, IL (US)

(73) Assignee: Electrolux Home Care Products, Inc., Charlotte, NC (US)

( * ) Notice: Subject to any disclaimer, the term of this patent is extended or adjusted under 35 U.S.C. 154(b) by 1234 days.

(21) Appl. No.: 12/033,520

(22) Filed: Feb. 19, 2008

(65) Prior Publication Data

US 2009/0205153 A1 Aug. 20, 2009

(51) Int. Cl.
*A46B 13/02* (2006.01)
*A46B 15/00* (2006.01)

(52) U.S. Cl. ..... 15/182; 15/179

(58) Field of Classification Search ..... 15/179, 15/182, 183
See application file for complete search history.

(56) References Cited

U.S. PATENT DOCUMENTS 2,130,325 A * 9/1938 Pardee ..... 15/368
4,209,872 A 7/1980 Maier
4,209,873 A 7/1980 Schaefer
4,238,870 A 12/1980 Fahlen
4,312,542 A 1/1982 Schaefer
4,372,004 A 2/1983 Vermillion
4,847,944 A * 7/1989 Lackner ..... 15/392
5,014,387 A * 5/1991 Hays ..... 15/339
6,437,465 B1 8/2002 Nishimura et al.
6,502,277 B1 1/2003 Petersson et al.
6,848,147 B2 2/2005 Syverson et al.
7,163,568 B2 1/2007 Sepke et al.
2006/0021184 A1 2/2006 Hawkins et al.

* cited by examiner

*Primary Examiner* — Randall Chin
(74) *Attorney, Agent, or Firm* — Hunton & Williams LLP

(57) ABSTRACT

An agitator having a hollow spindle housing with first and second ends, and one or more agitating devices projecting from the spindle housing. A first bearing retainer holds the first end of the spindle housing and a first race of a first bearing, and a second bearing retainer holds the second end of the spindle housing and a first race of a second bearing. A first agitator mount holds a second race of the first bearing, and a second agitator mount holds a second race of the second bearing. A rigid inner support may be located inside the spindle housing and connect the first and second bearing retainers together to hold the first races of the first and second bearings in axial alignment. The spindle housing may have sound reducing members to reduce the amplitude of human-audible sounds generated by the agitator.

19 Claims, 5 Drawing Sheets

Fig. 5
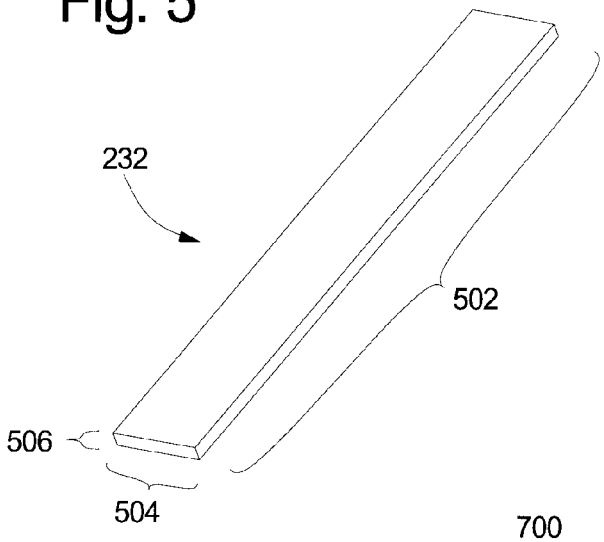
Fig. 7
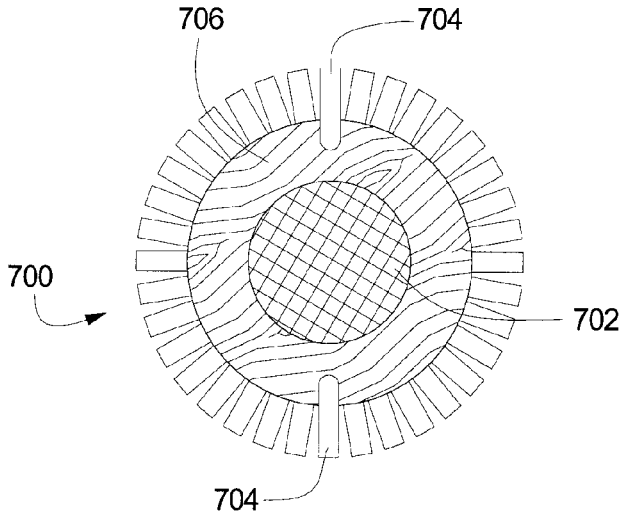
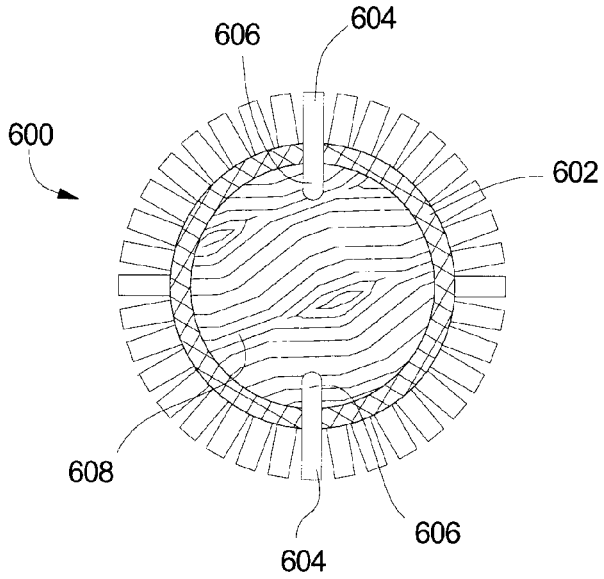
Fig. 6
Fig. 8
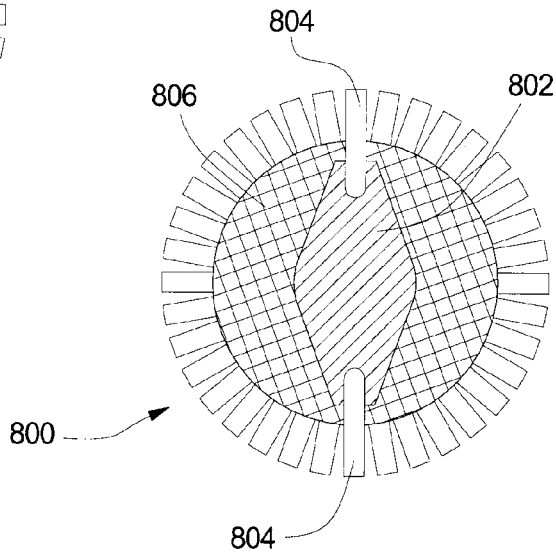

BRUSHROLL WITH SOUND REDUCING FEATURES

FIELD OF THE INVENTION

The present invention relates generally to a cleaning device and, more specifically, to an agitator having features for reducing the sound created by the agitator during use.

BACKGROUND OF THE INVENTION

It is well known in the art of cleaning devices to use agitators to clean surfaces such as carpets, upholstery, and bare floors. These agitators can function in a variety of ways and appear in many forms. One typical embodiment of an agitator is a tube that rotates around its longitudinal axis and has one or more features that agitate the surface as it rotates. Such features typically include one or more bristle tufts, flexible flaps, bumps, and so on. The agitation moves or dislodges dirt from the surface, making it easier to collect by the cleaning device. Agitators can be employed in a variety of cleaning devices including vacuum cleaners and sweepers. In a sweeper, the agitator typically moves or throws the dirt directly into a receptacle, and in a vacuum cleaner or similar device the dirt may be entrained in an airflow generated by a vacuum within the cleaning device, and thereby conveyed to a filter bag, cyclone separator or other kind of dirt collection device in the vacuum cleaner. An example of such an agitator is shown in U.S. Pat. No. 4,372,004, which reference is incorporated herein.

SUMMARY OF THE INVENTION

One exemplary embodiment provides an agitator having a hollow spindle housing having a first end and a second end, one or more agitating devices projecting from the spindle housing, a first bearing retainer adapted to hold the first end of the spindle housing and a first race of a first bearing, a first agitator mount adapted to engage a cleaning device housing and hold a second race of the first bearing, a second bearing retainer adapted to hold the second end of the spindle housing and a first race of a second bearing, and a second agitator mount adapted to engage the cleaning device housing and hold a second race of the second bearing. A rigid inner support is located inside the spindle housing and connects the first bearing retainer to the second bearing retainer to hold the first race of the first bearing and the first race of the second bearing in axial alignment.

Another exemplary embodiment provides an agitator having a hollow spindle housing having a first end and a second end, one or more agitating devices projecting from the spindle housing, a first bearing adapted to rotatably mount the first end of the spindle housing to a cleaning device, a second bearing adapted to rotatably mount the second end of the spindle housing to a cleaning device, and one or more sound reducing members associated with the spindle housing and adapted to reduce the amplitude of human-audible sounds generated by the agitator.

Another exemplary embodiment provides an agitator having a hollow spindle housing having a first end and a second end, one or more agitating devices projecting from the spindle housing, a first bearing adapted to rotatably mount the first end of the spindle housing to a cleaning device, a second bearing adapted to rotatably mount the second end of the spindle housing to a cleaning device, means to hold the first bearing and the second bearing in axial alignment, and means to reduce the amplitude of human-audible sounds produced by the agitator as the agitator rotates.

BRIEF DESCRIPTION OF THE DRAWINGS

Various exemplary aspects of the invention will be readily understood from the following detailed description and the accompanying drawings, which are exemplary only, and not intended to limit the invention.

FIG. 5 is a perspective view of an insert of FIG. 2, shown as it would appear if laid flat.

FIG. 6 is an end view of another exemplary agitator having sound reducing features.

FIG. 7 is an end view of another exemplary agitator having sound reducing features.

FIG. 8 is an end view of another exemplary agitator having sound reducing features.

DETAILED DESCRIPTION OF THE PREFERRED EMBODIMENTS

It has been found that agitators can generate a significant amount of sound during use. The sound may come from various sources. For example, the agitator may have bristles that make noise as they move through the air, the agitator bristles or other agitating surfaces may make noise as they contact the surface being cleaned, and the agitator may generate vibrations within the agitator or the surrounding cleaning device body that create human-audible sounds (i.e., sounds having a frequency of between about 15 and about 20,000 hertz). Such sounds may be undesirable for numerous reasons, such as fatiguing the user and disturbing the surrounding environment. It has also been found that conventional brushrolls can suffer from bearing misalignment problems that shorten the useful life of the brushroll or necessitate replacement of bearings, bushings or other rotating mounts.

Figure 1:
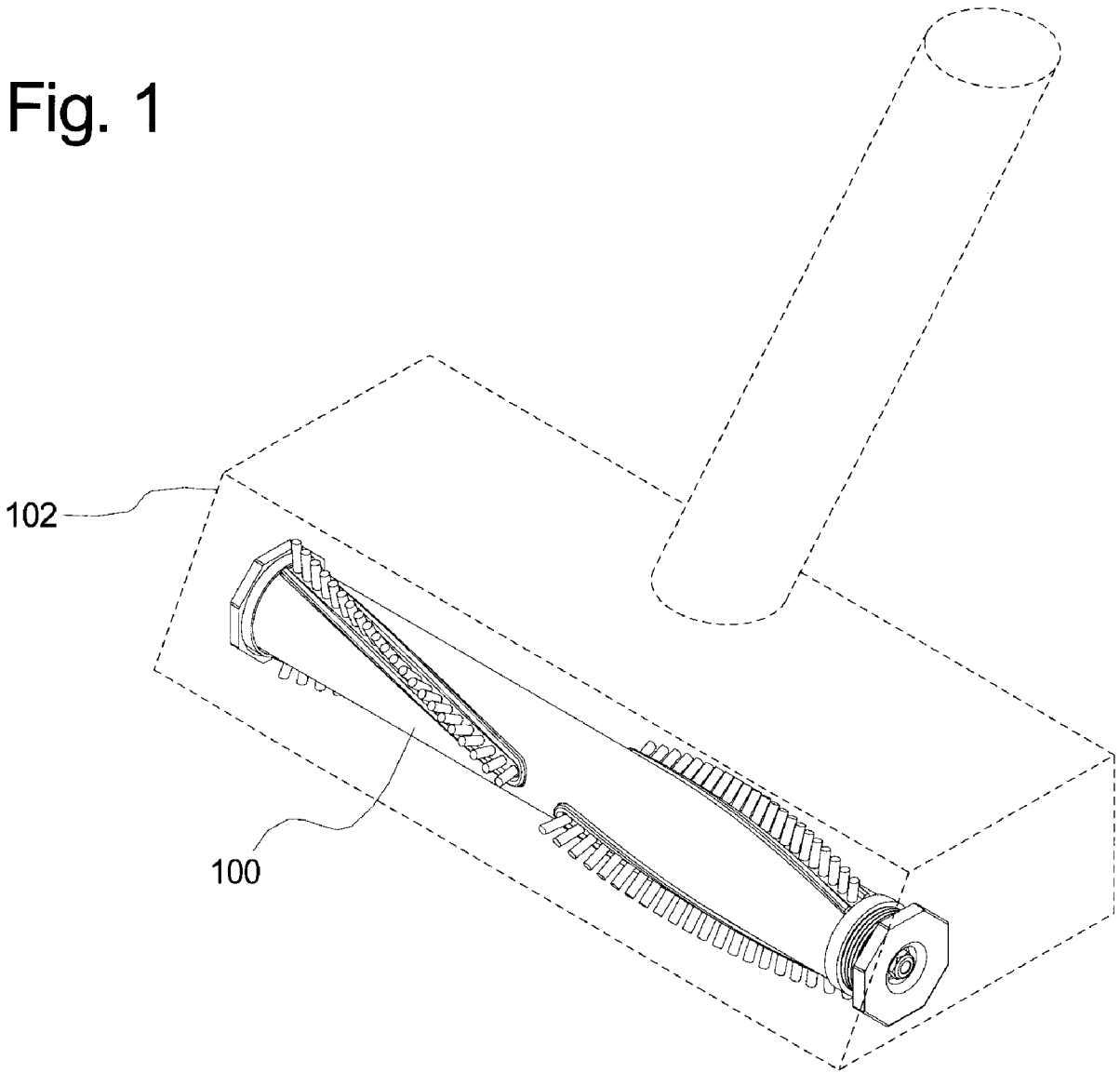
FIG. 1 is a perspective view of an exemplary agitator having sound reducing features.

The present invention generally provides an agitator having sound and/or vibration reducing features that are added to or integrated into the agitator, and bearing alignment features that help orient the bearings or other rotating supports to improve their reliability. Embodiments of the invention may be used with any type of cleaning device, such as upright vacuums, canister vacuums, central vacuum systems, or sweepers. For example, in one embodiment, shown in FIG. 1, the invention may provide an agitator 100 that is mounted in a cleaning head 102 for a floor sweeper or a vacuum cleaner. Such cleaning heads 102 are known in the art, and may include features such as a motor to drive the agitator 100 by a belt or gears or other known mechanisms, a dirt receptacle, wheels to support the cleaning head 102 at a fixed or variable height above the floor, one or more air passages that lead to a vacuum source, and so on. Non-limiting examples of various devices with which an agitator may be used are shown in U.S. Publication No. 2006/0021184, and U.S. Pat. Nos. 6,502,277 and 7,163,568. The foregoing references are incorporated herein.

Figure 2:
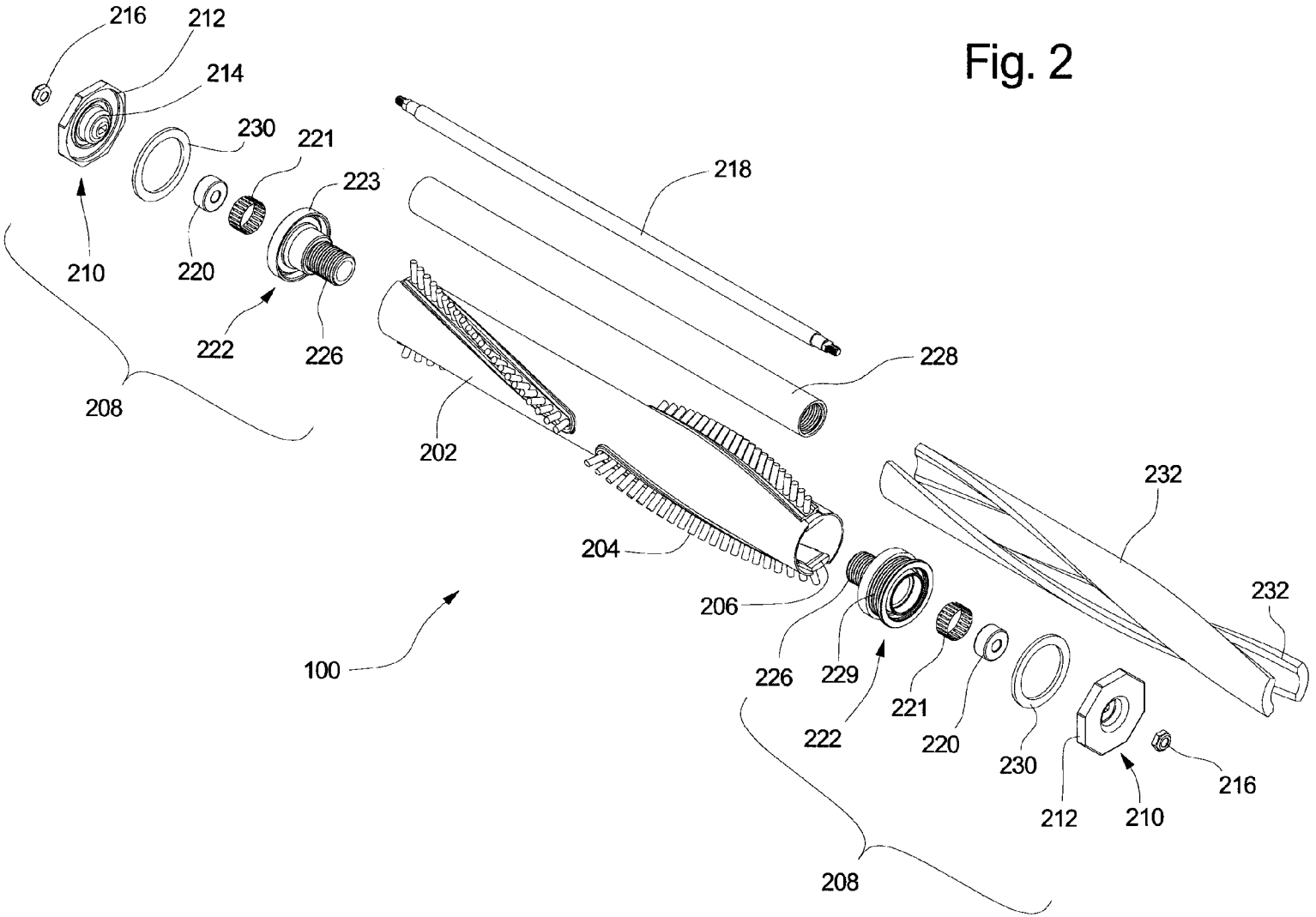
FIG. 2 is an exploded view of the agitator of FIG. 1.
Figure 3:
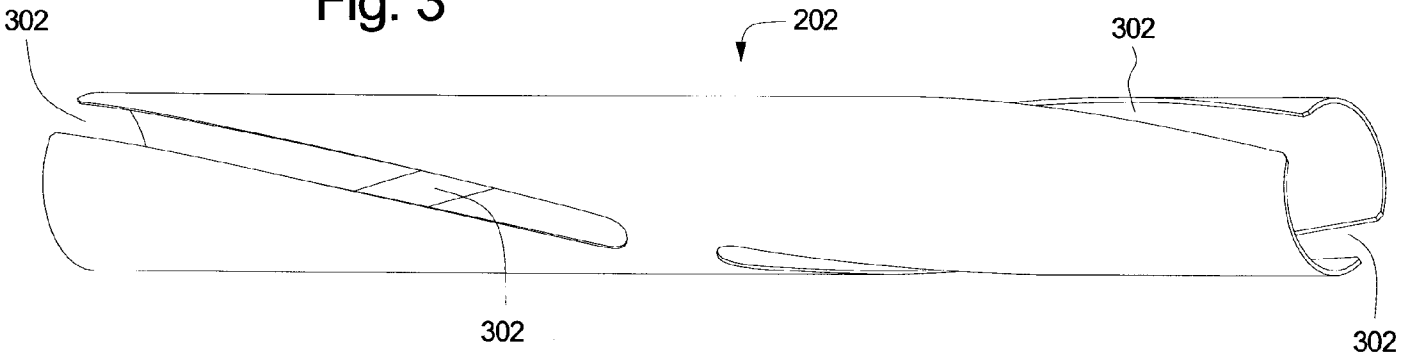
FIG. 3 is a perspective view of the agitator of FIG. 2.
Figure 4:
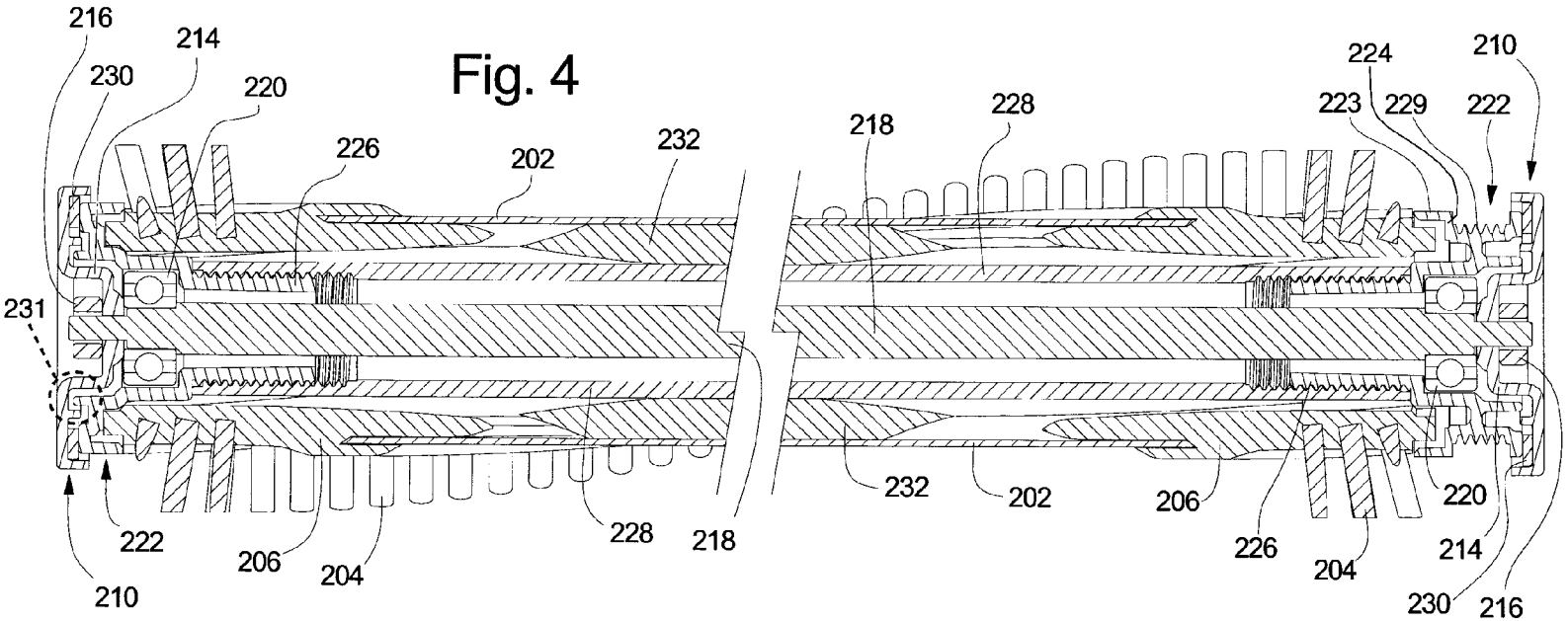
FIG. 4 is a cutaway front view of the agitator of FIG. 2, showing sound reducing and bearing alignment features therein.

As shown in FIGS. 2-4, the exemplary agitator 100 may include a tubular spindle housing 202 from which a number of agitating devices, shown as bristles 204, extend. The bristles 204 may be mounted to pliable mounting strips 206 that are embedded in helical slots 302 (FIG. 3) in the spindle housing 202. As shown in FIG. 3, two helical slots 302 originate at each end of the spindle housing 202 and extend to a point short of the agitator housing midpoint. The slots 302 form a double-helix pattern, and each slot may end at a point about ninety degrees, with respect to a plane orthogonal to the spindle housing axis, from its starting point. In the exemplary embodiment, the mounting strips 206 are adapted to slide into the slots 302 to fix the bristles 204 in place. If desired, the strips 206 and bristles 204 may be removable so that they can be replaced if they become worn out or damaged. In alternative embodiments, different numbers, arrangements and types of agitating devices may be used, and the agitating devices may be mounted in any number of known ways. For example, one or more of the bristles 204 may be replaced by one or more beater bars (provided either as separate parts or formed as part of the spindle housing 202), flaps, or other agitators. Variations on the number, arrangement, and kind of agitating device will be apparent to persons of ordinary skill in the art in view of the present disclosure.

The exemplary agitator 100 is mounted in the housing 102 by one or more bearings, bushings or similar devices. The agitator 100 may be mounted at each end, but it also may be mounted by intermediate bearings or bushings located along its length. In the exemplary embodiment, the agitator 100 is mounted to the housing 102 by a pair of mounting assemblies 208 that permit the agitator to rotate relative to the housing 102.

Each exemplary mounting assembly 208 includes an agitator mount, such as an end cap 210 having a radially extending octagonal wall 212 that fits into a corresponding recess (not shown) in the housing 102, as known in the art. Each end cap 210 also has a central aperture 214 into which a retaining nut 216 fits. The retaining nut 216 threads onto an axle shaft 218 that passes through the spindle housing 202. The axle shaft 218 is threaded at each end to accept the retaining nuts 216, and may have a stepped diameter that abuts a pair of bearings 220 and/or the end caps 210 to hold the bearings 220 and/or end caps 210 at the proper distance from one another. As shown in FIG. 4, once installed, the retaining nuts 216 hold the end caps 210 to one another, with the rest of the agitator 100 captured between them. During use, the end caps 210, retaining nuts 216 and shaft 218 typically are non-rotatably mounted to the housing 102.

The remainder of the agitator 100 may be rotatably mounted on the axle shaft 218, and between the end caps 210, by a pair of bearings 220 located adjacent each end cap 210. The bearings 220 each may have an inner race that fits over the axle shaft 218 and abuts the respective end cap 210, and an outer race that fits within a corresponding bearing retainer 222. Each bearing retainer 222 includes a hollow cylindrical portion into which the outer race of its respective bearing 220 fits. If desired, the bearings 220 may be firmly locked in place by adhesives, staking, friction fitment, and so on. One or more shims 221 or other spacers also may be provided to ensure that the bearing 220 fits snugly within the retainer 222. Exemplary shims 221 comprise corrugated stainless steel bands that wrap around the outer race of each bearing 220 and are adapted to deform slightly as the bearing 220 is pressed into the bearing retainer 222. The bearings 220 may comprise any suitable rotary mounting device, such as roller bearings, ball bearings, or simple bushings. For purposes of this disclosure, any device that provides a rotating support is referred to as a bearing. While it is not strictly required, it has been found that installing the bearings 220 with the shims 221 and an adhesive may reduce the volume of noise generated by the agitator 100 when it rotates.

Each bearing retainer 222 includes a radially extending wall 224 that can be fixed to a respective end of the spindle housing 202 to hold the bearing retainer 222 in place. To ensure that the bearing retainers 222 are properly aligned, each bearing retainer 222 may have an axially extending lip 223 that wraps around the end of the spindle housing 202. Such lips 223 may hold the spindle housing by simply capturing it in place. Of course, the retainers 222 may instead be fitted to the spindle housing 202 by threads, or other attachments and/or locating features. For example, the retainers 222 may have lips that wrap around the spindle housing and are deformed slightly to pinch against and hold the spindle housing 202. Each bearing retainer 222 also may include a radially extending cylindrical inner wall 226 that protrudes inside the spindle housing 202. As shown in FIG. 4, a portion of the inner wall 226 may be adapted to receive the bearing 220.

The inner wall 226 also may be surrounded by (or fit over) an inner support 228 that extends across the spindle housing 202 to join the two bearing retainers 222 together. The inner support 228 may help stabilize the bearing retainers 222 to more firmly hold the spindle housing 202 in place. The shown inner support 228 has internal threads that engage corresponding external threads formed on the end of each bearing retainer 222, but these parts may be attached by slip or friction fit, adhesives, bayonet fittings, or other interlocking or engaging features. While the illustrated exemplary inner support 228 is shown as a tube, such as an aluminum tube, it will be appreciated that the support 228 may be replaced by any suitable rigid connecting structure that joins the two bearing retainers 222 to one another to help maintain their axial alignment with one another, which may increase the operating life of the bearings. The support 228 also may be provided as part of one of the bearing retainers 222, such as by being formed as an extension of one or both of the bearing retainers' inner walls 226.

If the connection between the bearing retainers 222 and the inner support 228 is sufficiently strong, it may not be necessary to positively connect the bearing retainers 222 to the spindle housing 202. For example, as noted above, the bearing retainers 222 may have outer lips 223 that simply capture the spindle housing 202 in place, but are not otherwise connected to the spindle housing 202. Even where no positive attachment is provided between the retainers 222 and the spindle housing 202, it still may be desirable to shape the retainers 222 and the spindle housing 202 so that they can not rotate relative to one another. For example, the spindle housing 202 may have notches into which corresponding tabs on the retainers 222 protrude, or vice-versa.

If desired, one of the bearing retainers 222 may include a drive surface 229, such as a smooth or toothed pulley gear. The drive surface 229 engages a belt, gear, or other drive device associated with a motor to rotate the agitator 100. Such a motor may be electric, air-driven, or any other suitable type of agitator drive motor, as known in the art. In embodiments in which the bearing retainers 222 are threaded to an inner support 228, the drive surface 229 may be adapted to rotate in a direction that tends to tighten the threaded connection between the retainers 222 and the inner support 228, to prevent them from being unscrewed if the agitator 100 encounters resistance. In an alternative embodiment, the motor may be mounted inside the agitator 100, as known in the art. In still other exemplary embodiments, the drive surface may be formed as part of the spindle housing 202, or as a separate part that is attached to the spindle housing 202. Such variations will be understood by persons of ordinary skill in the art in view of the present disclosure.

The exemplary mounting assemblies 208 may include features for preventing dirt and hair from contaminating the bearings, and other useful features known in the art. For example felt washers 230 may be located between each end cap 210 and its respective bearing retainer 222 to inhibit foreign objects from contacting the bearings. The washers 230 may be free-floating, or they may be attached to either the end caps 210 or the bearing retainers 222. Also, a labyrinth seal 231 comprising interposed annular walls formed on the end caps 210 and bearing retainers 222 also may be useful for inhibiting hair and other contaminants from reaching the bearings 220.

One or more sound and/or vibration reducing features are provided with the agitator 100 to reduce sounds and/or vibrations generated by the agitator 100 as it rotates, and possibly to provide other benefits, such as to help balance the agitator 100. In the exemplary embodiment of FIGS. 2-4, two sound-reducing inserts 232 are used. Each insert 232 comprises a rectangular foam strip, as shown in FIG. 5. The inserts 232 are positioned between the spindle housing 202 and the inner support 228, and are located in the helical spaces between the bristle mounting strips 206 (which protrude radially inwards from the spindle housing 202 towards the inner support 228, as shown in FIG. 4).

As shown in FIG. 5, each insert 232 has a length 502, width 504 and height 506. The inserts 232 are formed from conventional polyester or polyurethane open- or closed-cell foam materials, such as those typically used in vacuum cleaner motor housings to absorb noises therein, but other materials may be used. Such materials may be flexible or pliable solid materials, liquids contained in flexible or rigid vessels, aggregates of small objects (such as foam pellets or the like), and so on. The sound reducing material also may comprise a rigid solid material, such as a stiffening rib provided to reduce vibrations in the wall of an agitator part. It is preferred, however, for the sound reducing material to be a structural part of the agitator that does not contribute significantly to its strength or rigidity, because such structural materials may be susceptible to generating their own vibration-induced sounds.

Non-limiting examples of alternative sound reducing materials include: open- and closed-cell foams, felt, rubber, plastics, fabric, thermoplastic elastomers ("TPE"), polyurethanes, cotton or synthetic stuffing, viscous gels, water, oil, and so on. Such features can be formed as separate parts and assembled with the agitator, as shown in the previous exemplary embodiment, or formed with or as part of other agitator features. For example, the spindle housing may include integrally-formed ribs or baffles that inhibit the structure from resonating at audible frequencies or interrupt airspaces in which standing air waves can resonate. As another example, the sound reducing inserts 232 may be formed as soft rubber parts that are overmolded on the inner support 228 or other parts, or may be provided as extensions of the pliable bristle mounting strips 206.

It should also be understood that the insert's shape and/or dimensions may be selected or modified to modify its sound reducing capabilities. In the exemplary embodiment, the inserts 290 are roughly the same length 502 as the spindle housing 202, have a height 506 sufficient to extend approximately the entire distance from the inner support 228 to the spindle housing 202, and have a width 504 sufficient to fully or almost fully occupy the helical spaces formed between the bristle mounting strips 206. In this embodiment, the inserts 232 are held firmly in place and are not likely to dislodge or shift during use. In other embodiments, the inserts 232 may have different shapes and sizes, and may be fixed in place by adhesives or fasteners, or they may be free-floating and allowed to move within the agitator 100.

The sound reducing features of the foregoing embodiment are expected to measurably change the nature or volume of the sound produced by the agitator 100 during use. For example, testing suggests that the foregoing embodiment may reduce the amount of sound that the agitator produces, and may reduce the total amplitude of the sound generated by a vacuum cleaner incorporating the agitator. Without being bound to any theory of operation, it is believed that this sound reduction may be attributed to one or more factors. For example the inserts 232 may prevent standing airwaves from forming in the space between the spindle housing 202 and the inner support 228, or they may prevent or damp vibrations that occur in these parts by virtue of their contact therewith. This may be particularly helpful in embodiments in which the spindle housing 202 or inner support 228 is made from relatively thin metal that might otherwise tend to resonate or vibrate. In addition, while vibrations created by the agitator during operation may generate audible sounds from the agitator itself, such vibrations also may travel to the housing in which the agitator is mounted or to other parts, and cause those parts to make audible sounds. The use of sound reducing features in the agitator may reduce the creation and transmittal of such vibrations, and may reduce the amount of noise produced by parts near the agitator in response to such vibrations. In addition to reducing the sound amplitude, embodiments of the invention also may be tailored to change the tone, pitch or timbre of sounds produced by an agitator, or to provide other benefits, such as to reduce inaudible vibrations that may fatigue the agitator or vacuum cleaner, or be perceptible by the user through touch.

In the foregoing exemplary embodiment, an agitator is provided having sound reducing inserts located within the agitator's spindle housing. In other embodiments, the sound reducing features may also or alternatively be located outside the spindle housing. Sound reducing inserts also may be used with other kinds of agitator. For example, in the exemplary embodiment of FIG. 6, the agitator 600 comprises a plastic or wooden dowel 602 to which bristles 604 are mounted by being stapled into holes 606 through the dowel wall. The dowel 602 is hollow, and a sound reducing material 608 is provided in the hollow center of the dowel 602 to damp vibrations of the dowel wall, and prevent the creation of standing airwaves in the hollow space within the dowel 602. The sound reducing material 608 may occupy the entire space, as shown, or it may be attached as a thin layer or at discrete locations to the dowel wall.

Another exemplary embodiment of an agitator having sound reducing features is shown in FIG. 7. Here, the exemplary agitator 700 comprises a spindle 702 having agitators 704 extending from its surface, and a layer of sound reducing material 706 provided on the spindle's outer surface. The sound reducing material 706 may be provided as a continuous later of material, as shown, or as one or more discrete features. Here, the sound reducing material 706 may be comprise a foam sheath that fits over the spindle 702, but it may instead be an overmolded soft rubber or other material. The sound reducing material 706 preferably is shaped and sized such that it does not contact the surface being cleaned as the agitator 700 rotates.

Still another exemplary embodiment of an agitator having sound reducing features is shown in FIG. 8. In this embodiment, the exemplary agitator 800 comprises a helical central rib 802 that provides a structural spindle. The central rib 800 is formed such that it is twisted about the agitator's rotary axis, as known in the art and shown, for example, in U.S. Pat. No. 7,243,393, which reference is incorporated herein. Agitators 804 protrude from the edges of the rib 802, and a sound reducing material 806 is provided on the spindle's outer surface, as in the above embodiment. The sound reducing material 806 may be shaped to form a circular profile, as shown, or to form other profiles. In this embodiment, the sound reducing material 806 may damp and reduce audible or perceptible vibrations in the rib 802. In addition, the sound reducing material 806 may form a relatively aerodynamic surface over the rib 802, which may reduce any sound the helical central rib 802 might make as it passes through the air if the sound reducing material 806 was not present. Again, it is preferred, but not strictly required, that the sound reducing material 806 does not contact the surface being cleaned. In still other embodiments, the sound reducing material 806 may be shaped to provide other aerodynamic features that further reduce sound. For example, the sound reducing material 806 may comprise nacelles or other aerodynamic shapes located in front of and/or behind the agitator bristles 804 to reduce the noise they create as they pass through the air.

Figure 9:
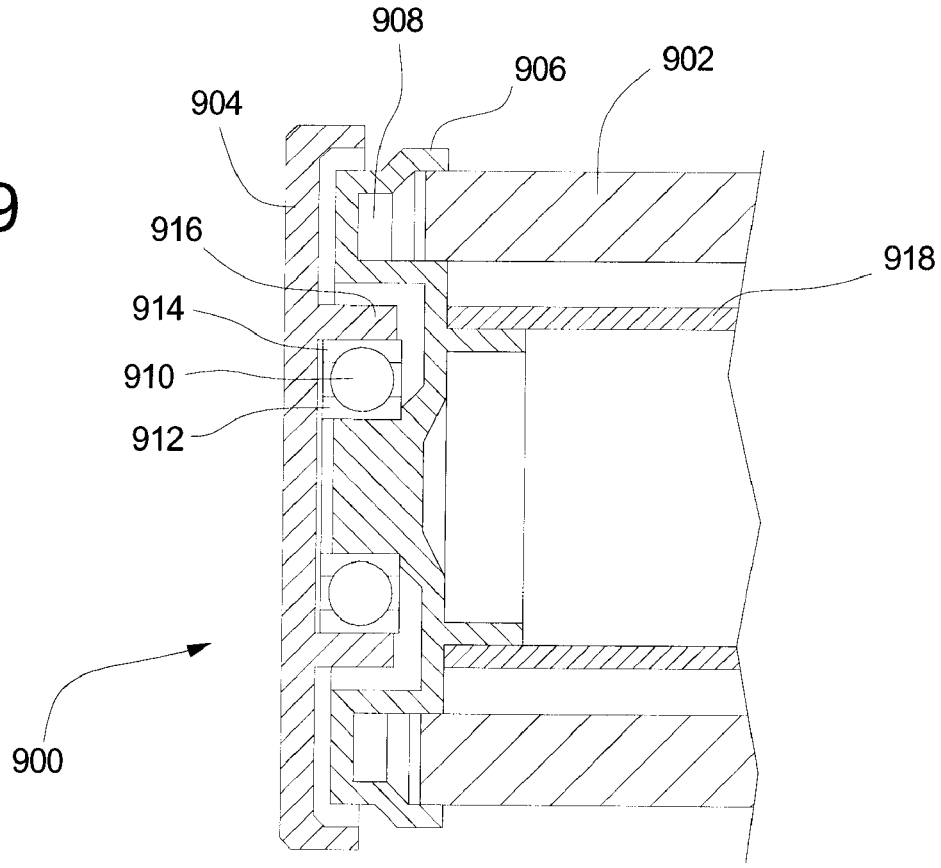
FIG. 9 is cutaway fragmented front view of another exemplary agitator having bearing alignment features.
Figure 10:
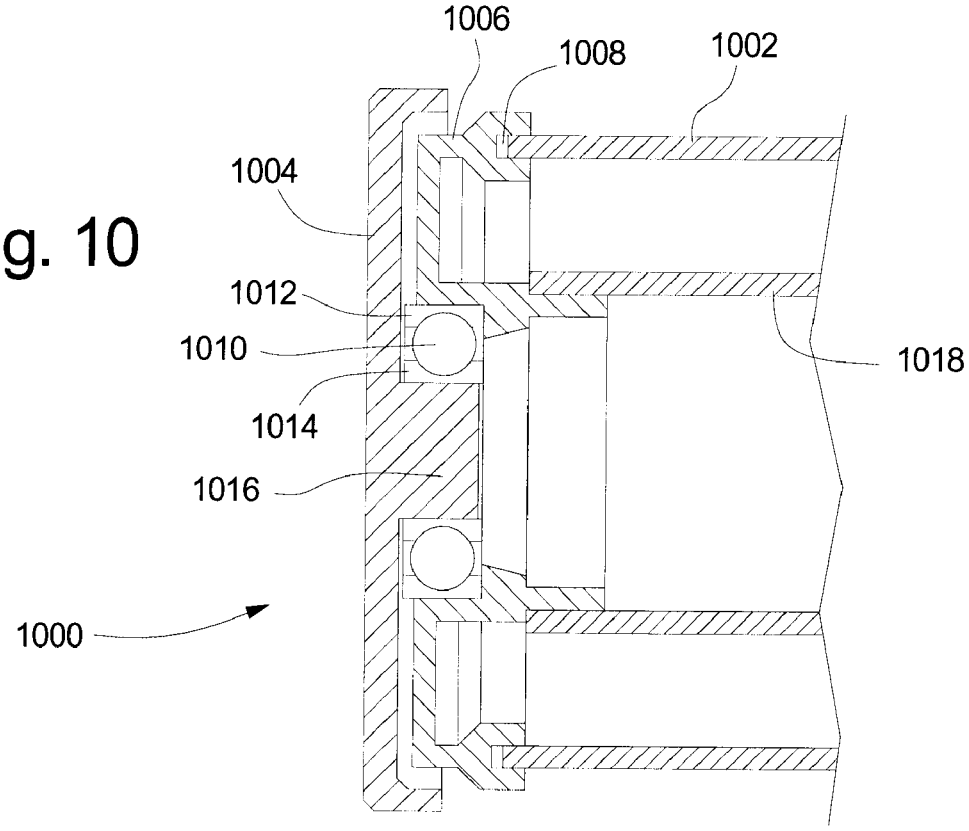
FIG. 10 is cutaway fragmented front view of another exemplary agitator having bearing alignment features.

Referring now to FIGS. 9 and 10, to additional exemplary embodiments of agitator bearing alignment features are illustrated and described. FIG. 9 provides an exemplary agitator 900 having a hollow spindle housing 902 that is mounted to a cleaning device housing by agitator mounts 904 (only one is shown) located at each end of the spindle housing 902. Any suitable agitating devices may be provided on the outer surface of the spindle housing 902 to contact a surface to be cleaned. The spindle housing 902 is held in place by a pair of bearing retainers 906 located at each end of the spindle housing 902. As shown, the bearing retainers 906 have an annular groove 908 into which the ends of the spindle housing 902 fit, but other attachments between these parts, such as threads, may be used instead. If desired, the spindle housing 902 may be free to move laterally a short distance while still being captured by the annular grooves 908. The bearing retainers 906 of the embodiment of FIG. 9 are similar to those described above, but differ in the manner in which they hold the bearings 910. Here, the bearing retainers 906 hold the bearings 910 by their inner race 912, as opposed to the prior exemplary embodiment, in which the bearing retainer 222 held the bearing 220 by its outer race. In this embodiment, the outer race 914 of each bearing 910 is held by an annular wall 916 or other structure forming part of the agitator mount 904. As with the previous exemplary embodiment, the bearing retainers 906 are joined to one another by an inner support 918. Any suitable means for attaching the inner support to the bearing retainers 906, such as welding, threads, adhesives, friction fitment or integral forming, may be used to join these parts in a rigid manner to help keep the bearings 910 axially aligned.

FIG. 10 also provides an exemplary agitator 1000 having a hollow spindle housing 1002 that is mounted to a cleaning device housing by agitator mounts 1004 located at each end of the spindle housing 1002. Any suitable agitating devices may be provided to contact a surface to be cleaned. The spindle housing 1002 is held in place by a pair of bearing retainers 1006 located at each end of the spindle housing 1002. As shown, the bearing retainers 1006 have an annular groove 1008 into which the ends of the spindle housing 902 fit, but other attachments between these parts, such as threads, may be used instead. In this embodiment, the bearing retainers 1006 hold the bearings 1010 by their outer race 1012. The agitator mount 1004 holds the inner race 1014 on a stub shaft 1016, as opposed to the embodiment of FIG. 3, in which the agitator mount (end cap 210) holds the inner race of the bearing in cooperation with the axle shaft 218. As shown, the agitator mount The bearing retainers 1006 are joined to one another by an inner support 1018. Of course, numerous variations on the foregoing embodiments will be apparent to persons of ordinary skill in the art in view of the present disclosure, and such embodiments are within the scope of the present invention.

While the embodiments of the invention described above are preferred, it will be recognized and understood that these embodiments are not intended to limit the inventions set forth in the appended claims. Various modifications may be made to these embodiments without departing from the spirit of the invention and the scope of the claims. For example, those skilled in the art will appreciate that other variations of an agitator and sound reducing material can be used with the present invention. These and other modifications are included within the scope of the appended claims.

What is claimed is:

1. An agitator for a cleaning device, the agitator comprising:

a hollow spindle housing having a first end and a second end;

one or more agitating devices projecting from the spindle housing;

a first bearing having a first race of the first bearing, and a second race of the first bearing;

a second bearing having a first race of the second bearing and a second race of the second bearing;

a first bearing retainer adapted to hold the first end of the spindle housing and the first race of the first bearing;

a first agitator mount adapted to hold the second race of the first bearing;

a second bearing retainer adapted to hold the second end of the spindle housing and the first race of the second bearing;

a second agitator mount adapted to hold the second race of the second bearing;

a rigid inner support located inside the spindle housing and connecting the first bearing retainer to the second bearing retainer to hold the first race of the first bearing and the first race of the second bearing in axial alignment; and a sound reducing insert positioned within the spindle housing.

2. The agitator of claim 1, wherein the one or more agitating devices comprise a plurality of bristle tufts.

3. The agitator of claim 1, wherein the first bearing retainer captures the first end of the spindle housing in place, and the second bearing retainer captures the second end of the spindle housing in place.

4. The agitator of claim 1, wherein the first race of the first bearing comprises an outer race of the first bearing, the second race of the first bearing comprises an inner race of the first bearing, the first race of the second bearing comprises an outer race of the second bearing, and the second race of the second bearing comprises an inner race of the second bearing.

5. The agitator of claim 4, further comprising an axle shaft extending within the spindle housing and the inner support, and between the first agitator mount to the second agitator mount, the axle shaft cooperating with the first agitator mount to hold the inner race of the first bearing, and cooperating with the second agitator mount to hold the inner race of the second bearing.

6. The agitator of claim 1, wherein the first race of the first bearing comprises an inner race of the first bearing, the second race of the first bearing comprises an outer race of the first bearing, the first race of the second bearing comprises an inner race of the second bearing, and the second race of the second bearing comprises an outer race of the second bearing.

7. The agitator of claim 1, wherein the inner support comprises a tube that joins the first bearing retainer to the second bearing retainer.

8. The agitator of claim 7, wherein the tube comprises a separate part that is threaded to the first bearing retainer and the second bearing retainer.

9. The agitator of claim 1, wherein the first bearing retainer comprises a drive surface adapted to be driven to rotate the agitator.

10. The agitator of claim 1, wherein the sound reducing insert is positioned between the spindle housing and the inner support.

11. The agitator of claim 10, wherein the sound reducing insert comprises one or more foam strips.

12. The agitator of claim 11, wherein the one or more foam strips are arranged in a helical pattern along the length of the spindle housing.

13. An agitator for a cleaning device, the agitator comprising:

a hollow spindle housing having a first end and a second end;

one or more agitating devices projecting from the spindle housing;

a first bearing adapted to rotatably mount the first end of the spindle housing;

a first bearing retainer connecting the first bearing to the first end of the spindle housing;

a second bearing adapted to rotatably mount the second end of the spindle housing;

a second bearing retainer connecting the second bearing to the second end of the spindle housing; and one or more sound reducing members associated with the spindle housing and adapted to reduce the amplitude of human-audible sounds generated by the agitator;

wherein the one or more sound reducing members are inside the spindle housing and located between the first bearing retainer and the second bearing retainer.

14. The agitator of claim 13, wherein the one or more agitating devices comprise a plurality of bristle tufts.

15. The agitator of claim 13, wherein the one or more sound reducing members are outside the spindle housing, and positioned with respect to the spindle housing and the one or more agitating devices such that they do not contact a surface being cleaned when the spindle housing rotates.

16. The agitator of claim 13, further comprising an inner support located inside the spindle housing and connecting the first bearing to the second bearing to hold the first bearing and the second bearing in axial alignment.

17. The agitator of claim 16, wherein the one or more sound reducing members are located between the inner support and the spindle housing.

18. The agitator of claim 13, wherein the one or more sound reducing members comprise one or more foam strips.

19. The agitator of claim 18, wherein the one or more foam strips are arranged in a helical pattern along the length of the spindle housing.

* * * * *